United States Patent [19]

Porta

[11] Patent Number: 5,075,927

[45] Date of Patent: Dec. 31, 1991

[54] HINGED MOUNTING BRACKET WITH SOLID LUBRICANT INSERTS

[76] Inventor: Scott S. Porta, 1038 West Ariel Rd., Edgewater, Fla.

[21] Appl. No.: 600,695

[22] Filed: Oct. 22, 1990

[51] Int. Cl.[5] ..... E05D 11/00

[52] U.S. Cl. ..... 16/273; 16/355

[58] Field of Search ..... 16/273, 355, 356

[56] References Cited

U.S. PATENT DOCUMENTS

| | | | |
|---|---|---|---|
| 2,302,661 | 11/1942 | Benson | 16/355 X |
| 3,698,260 | 10/1972 | Shellhause | 16/355 X |
| 3,921,225 | 11/1975 | Suska | 16/273 |

FOREIGN PATENT DOCUMENTS

| | | | |
|---|---|---|---|
| 626192 | 8/1961 | Canada | 16/273 |
| 2750310 | 5/1979 | Fed. Rep. of Germany | 16/273 |

OTHER PUBLICATIONS

Continuous Hinge, T. J. Mattuson-Xerox Disclosure Journal, vol. 8, No. 3, p. 251 (May/Jun. 1983).

*Primary Examiner*—Lowell A. Larson

*Assistant Examiner*—Michael J. McKeon

*Attorney, Agent, or Firm*—William M. Hobby, III

[57] ABSTRACT

The present invention relates to a hinged mounting bracket for hingedly mounting an item to a flat surface or the like and includes an elongated base member which interacts with an elongated swing member to form a hinge. The elongated base member has a cross section shaped to form a raised portion having an arcuate top with an arcuate passageway therein opening on one side thereof. The elongated swing member has a cross section shape having an attaching end and an arcuate end. The arcuate end of the swing member is rotatably fitted into the elongated base member arcuate passageway and extending partially around the arcuate top of the base member so that the elongated swing member is rotatably hinged in the elongated base member arcuate passageway. An elongated solid lubricant is inserted between a pair of ledges formed in the elongated base member passageway and a second elongated solid lubricant is fitted between ledges formed on the inside of the arcuate shaped end of the elongated swing member so that the hinged mounting bracket rotates on lubricating surfaces.

8 Claims, 1 Drawing Sheet

HINGED MOUNTING BRACKET WITH SOLID LUBRICANT INSERTS

BACKGROUND OF THE INVENTION

The present invention relates to a mounting bracket and especially to a hinged mounting bracket which allows an item to hingedly rotate on a surface.

In the past, a wide variety of mounting brackets have been provided. A typical mounting bracket might include a base yoke member having a pinned arm attached thereto with a hinge pin so that the arm can swing on the mounted yoke. Hinges can also be used for mounting brackets and there have been a wide variety of hinges in the past which allows one of the hinge portions or straps to be attached to a surface while the other one rotates or swings thereon. One common type of hinge is a piano hinge which is an elongated hinge with a hinge pin extending the length of the hinge and having each side of the hinge alternate for short lengths to form a passageway for the passage of the hinge pin. In contrast to prior art mounting brackets, the present invention is especially adapted for mounting items such as outboard motors and the like to the back of boats where heavy loads are to be mounted in a secure fashion but where extruded aluminum bracket portions are desirable because of corrosion problems. The present hinged mounting bracket is formed of two elongated extrusion portions extruded from aluminum which are connected together to form a very strong hinged mounting bracket with an elongated base member attachable to a flat surface with screws or the like and having an elongated swing member riding therein. The hinged mounting bracket has provisions for thin strips of a solid lubricant, such as a nylon or TEFLON material, to be snapped on both sides of the engaging mounting bracket portions to thereby provide a constant lubricant without the use of oil and which lubricants can be quickly replaced as desired.

SUMMARY OF THE INVENTION

The present invention relates to a hinged mounting bracket for hingedly mounting an item to a flat surface or the like and includes an elongated base member which interacts with an elongated swing member to form a hinge. The elongated base member has a cross-section shaped to form a raised portion having an arcuate top with an arcuate passageway therein opening on one side thereof. The elongated swing member has a cross section shape having an attaching end and an arcuate end. The arcuate end of the swing member is rotatably fitted into the elongated base member arcuate passageway and extending partially around the arcuate top of the base member so that the elongated swing member is rotatably hinged in the elongated base member arcuate passageway. An elongated solid lubricant is inserted between a pair of ledges formed in the elongated base member passageway and a second elongated solid lubricant is fitted between ledges formed on the inside of the arcuate shaped end of the elongated swing member so that the hinged mounting bracket rotates on lubricating surfaces.

BRIEF DESCRIPTION OF THE DRAWINGS

Other objects, features, and advantages of the present invention will be apparent from the written description and the drawings in which.

DETAILED DESCRIPTION OF THE PREFERRED EMBODIMENT

Figure 1:
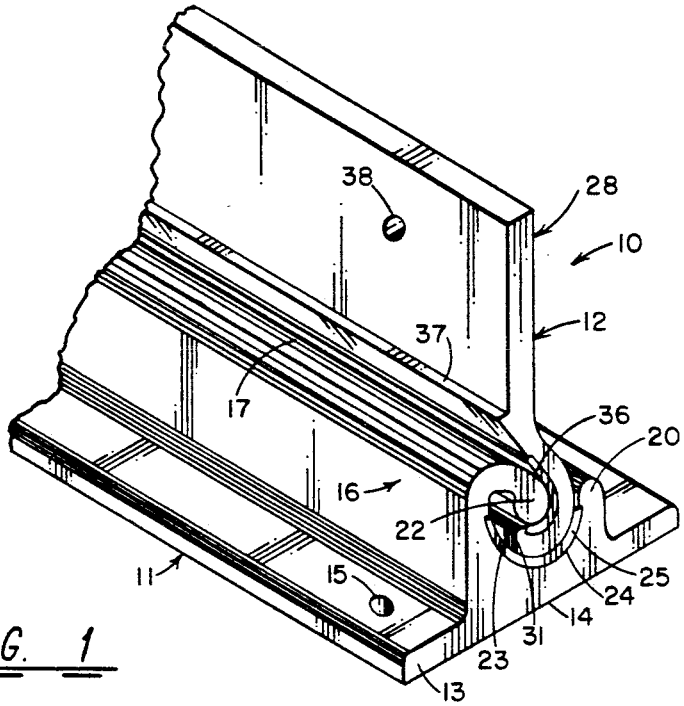
FIG. 1 is a partial perspective view of a hinged mounting bracket in accordance with the present invention.

Referring to the drawings, FIGS. 1-5, a hinged mounting bracket 10 is illustrated having an elongated base member 11 having an elongated swing member 12 rotatably attached to the base member. The base member 11 has an elongated base portion 13 having a flat bottom 14 and a plurality of openings 15 for readily attaching to a flat surface by screw fasteners, or the like, through the openings 15. The hinge mounting bracket 10 can be made in any length since both the elongated base member and the elongated swing member are aluminum extrusions. Both components can, however, be made of different materials as desired. The elongated base member 11, as shown in the cross section of FIG. 2, has a raised attachment or hinge portion 16 having an arcuate top 17. An arcuate valley portion 18 is formed along the base portion with a protruding portion 20. The raised portion 21 forms a generally "hook" shape having a bulbous or enlarged end 22 so that the arcuate passageway 23 is formed between the arcuate valley portion 18 and the hook portion 21. A removed portion 24 is removed from the valley portion 18 in the base and has an elongated thin strip of solid lubricant 25 placed in the removed portion and held between the ledge 26 and the ledge 27 formed by the removed portion 24 which allows the shaped polymer strip 25 to be snapped in place between the ledges 26 and 27. The elongated swing member 12 has an attaching end 28 and a hinge end 30. The hinge end 30 is of a generally "hook" shape having a rounded end 31 with an inside arcuate portion 32 having a removed portion 33 forming a first ledge 34 and a second ledge 35 so that a thin strip of solid lubricant 36 can be snapped between the ledges 34 and 35.

Figure 2:
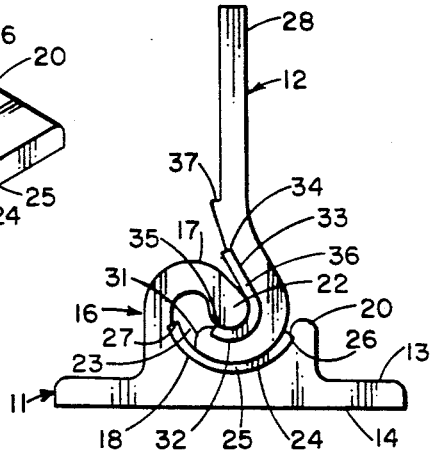
FIG. 2 is an end elevation of the mounting bracket in accordance with FIG. 1.
Figure 3:
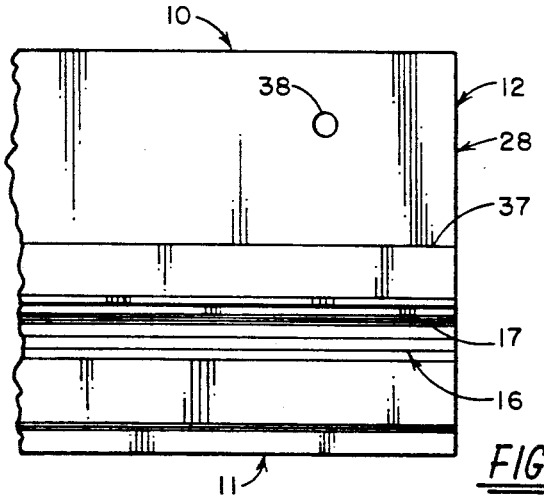
FIG. 3 is a partial side elevation of the mounting bracket of FIG. 1.
Figure 5:
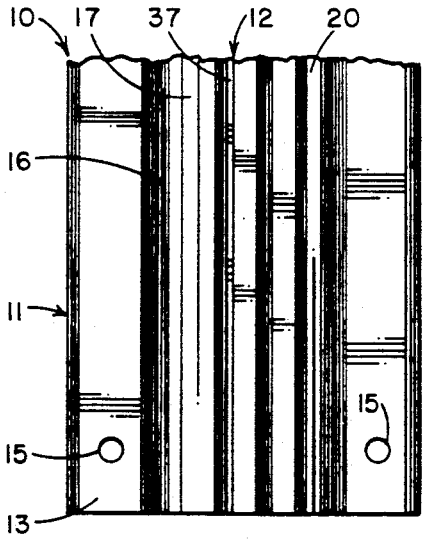
FIG. 5 is a top plan view of a hinged mounting bracket portion of FIG. 1.
Figure 4:
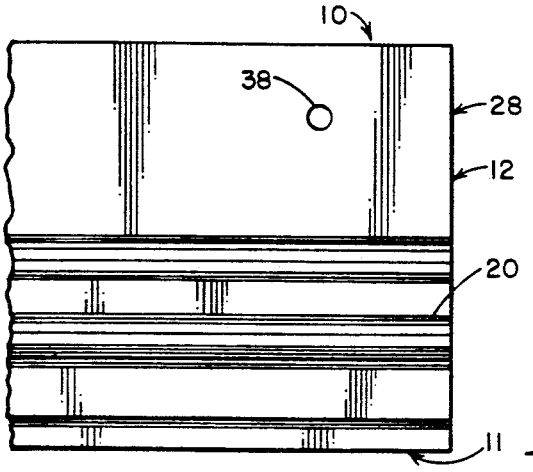
FIG. 4 is a second partial side elevation of the mounting bracket of FIG. 1.

The hinge end 30 is fitted within the passageway 23, as shown in FIG. 2, and can slide into and out of the passageway 23 as the swing portion 12 moves or rotates on the base portion 11. The attaching portion 28 has a long extending member and forms an elongated ledge 37 which acts as a stop for a member being attached to the mounting bracket so that an attached portion can be bolted thereto or can be mounted with threaded fasteners or bolts through the apertures 38 formed in the attaching portion. It should be clear that both the base portion 11 and the elongated swing member 12 can be inexpensively made with aluminum extrusions while the solid lubricant strips 25 and 36 can be thin strips of nylon or TEFLON, or any other polymer which acts as a solid lubricant material and made the exact width for snapping between the ledges 26 and 27 and between the ledges 34 and 35 to form a continuous polymer lubricant surface for the moving swing member 12 to ride in as it rotates the arcuate portion 30 within the passageway 23 around the enlarged portion 22. The raised portion 16, arcuate portion 17 is also shaped with the arcuate portion 30 of the elongated swing member to swing therearound while still riding on the solid lubricant strip 36.

Inasmuch as the hinge mounting bracket 10 is made with extrusions and continuous polymer lubricant strips, they can be made to any length desired or made in an indefinite length and cut to size and the base portion 13 can be bolted or attached with screws to a flat surface while the swing arm portion 12 can be readily attached to a member being hingedly mounted to the flat surface by sliding the cooperating attaching member until it reaches the stop 37 where it can be bolted through cooperating openings 38 or which can be attached in any manner desired including welding or with rigid clamps. It should be clear at this time that an inexpensive but very strong hinge mounting bracket has been provided for attaching heavy loads to a flat surface or the like. It should also be clear, however, that the base portion member 11 can be shaped to fit on a surface other than a flat surface if desired and that the forms illustrated are to be considered illustrative rather than restrictive.

I claim:

1. A hinge mounting bracket comprising:

an elongated base member having a cross-section shape forming a raised portion having an arcuate top and having an arcuate passageway therein opening on one side thereof, said arcuate passageway having a removed portion along one side thereof to form a pair of parallel ledges; and an elongated swing member having a cross-section shape having an attaching end and an arcuate end, the arcuate end being rotatable fitted into said elongated base member arcuate passageway and partially around said arcuate top, said elongated swing member having a removed portion along the inside of said arcuate shaped end to thereby form two parallel ledges; and a pair of elongated solid lubricant inserts, one fitted between said pair of ledges in said elongated base member and the other solid lubricant insert fitted between said ledges on the inside of said arcuate shaped end of said elongated swing member, whereby said elongated swing member is rotatably mounted to said elongated base member on solid lubricant surfaces.

2. A hinged mounting bracket in accordance with claim 1 in which said elongated base member cross-section shape includes a flat base portion for attachment to a planar surface.

3. A hinged mounting bracket in accordance with claim 2 in which said elongated base member flat base portion has a plurality of opening therein for attaching with screw fasteners or the like to a planar surface.

4. A hinged mounting bracket in accordance with claim 3 in which said elongated base member arcuate passageway is formed with an arcuate portion on the elongated base member flat base portion and having a generally hook shaped portion extending from said elongated base portion partially over said arcuate portion on said base portion thereby forming an arcuate passageway therebetween.

5. A hinged mounting bracket in accordance with claim 4 in which said elongated base member generally hook shaped portion has a generally rounded end portion thereon.

6. A hinged mounting bracket in accordance with claim 5 in which said elongated swing member having a cross-section shape attaching end has an extending attachment arm having a stop ledge formed thereon.

7. A hinged mounting bracket in accordance with claim 6 in which said pair of elongated solid lubricant inserts are elongated strips of nylon.

8. A hinged mounting bracket in accordance with claim 7 in which said elongated base member and said elongated swing member are aluminum extrusions.

* * * * *